US005175584A

United States Patent [19]

Usui

[11] Patent Number: 5,175,584

[45] Date of Patent: Dec. 29, 1992

[54] CLEANING CONTROL DEVICE FOR IMAGE FORMING EQUIPMENT

[75] Inventor: Noriyuki Usui, Kawasaki, Japan

[73] Assignee: Ricoh Company, Ltd., Tokyo, Japan

[21] Appl. No.: 599,994

[22] Filed: Oct. 19, 1990

[30] Foreign Application Priority Data

| | | | |
|---|---|---|---|
| Oct. 21, 1989 | [JP] | Japan | 1-123214[U] |
| Oct. 26, 1989 | [JP] | Japan | 1-277037 |
| Mar. 26, 1990 | [JP] | Japan | 2-73374 |
| Aug. 31, 1990 | [JP] | Japan | 2-228176 |

[51] Int. Cl.[5] ..... G03G 21/00

[52] U.S. Cl. ..... 355/208; 355/296

[58] Field of Search ..... 355/203, 204, 208, 219, 355/296, 297, 215, 210

[56] References Cited

U.S. PATENT DOCUMENTS

| | | | |
|---|---|---|---|
| 4,395,112 | 7/1983 | Miyakawa et al. | 355/208 X |
| 4,945,389 | 7/1990 | Usui et al. | 355/296 |
| 4,962,407 | 10/1990 | Ueda | 355/208 |

*Primary Examiner*—A. T. Grimley

*Assistant Examiner*—Sandra L. Brasé

*Attorney, Agent, or Firm*—Oblon, Spivak, McClelland, Maier & Neustadt

[57] ABSTRACT

A cleaning control device incorporated in electrophotographic image forming equipment for controlling the removal of toner remaining on a photoconductive element or image carrier after image transfer. Before the removal of the remaining toner, the surface potential of the photoconductive element is controlled to a predetermined value on the basis of the amount of remaining toner. Since the reference potential of the photoconductive element is determined in association with the amount of remaining toner, a minimum electric field capable of effecting cleaning is applied at all times. The reference potential is changed in response to aging. The remaining amount of toner is detected by a photoelectric transducer, while the electric field for cleaning is controlled in response to the detected amount of remaining toner. Further, the reference potential is changed in response to the instantaneous humidity around the photoconductive element.

7 Claims, 9 Drawing Sheets

CLEANING CONTROL DEVICE FOR IMAGE FORMING EQUIPMENT

BACKGROUND OF THE INVENTION

The present invention relates to image forming equipment of the type forming an image by an electrophotographic procedure and. more particularly, to a device incorporated in this type of equipment for controlling the cleaning of an image carrier implemented with a photoconductive element, i.e., the removal of a toner remaining on the image carrier.

An electrophotographic copier, facsimile transceiver and laser beam printer are typical examples of image forming equipment of the type forming an image by executing an electrophotographic procedure that includes a charging, exposing, developing, transferring, separating, and cleaning steps, as is well known in the art. This type of image forming equipment has a photoconductive element which plays the role of an image carrier for carrying an image thereon. To remove toner which remains on the photoconductive element after image transfer, the equipment executes a cleaning step by use of a cleaning roller which is applied with a cleaning bias voltage and on which a cleaning agent forms a magnet brush. To enhance the cleaning ability, it has been customary to charge, before the above cleaning step, the photoconductive element to the same polarity as the remaining toner to thereby reduce the electrostatic cohesion acting therebetween. This is successful in facilitating the removal of the remaining toner from the photoconductive element and is usually referred to as precleaning discharge. The cleaning ability achievable with the magnet brush formed on the cleaning roller is noticeably effected by the electric field which is developed at the time of cleaning, i.e., the potential on the photoconductive element undergone precleaning charge and the bias voltage applied to the cleaning roller. Hence, a desirable cleaning characteristic is not attainable unless the value of such an electric field for cleaning is confined to an adequate range. Should the electric field have a value not lying in the adequate range, the toner would again deposit on the photoconductive element after the cleaning step, degrading the cleaning ability. It has been reported that the adequate electric field range depends on the amount of toner remaining on the photoconductive element. In light of this, the bias voltage applied to the cleaning roller may be controlled on the basis of a detected amount of toner remaining on the photoconductive element, as disclosed in Japanese Patent Laid-Open Publication No. 176085/1982 by way of example. This kind of scheme, however, cannot compensate for the deterioration of the cleaning agent that forms a magnet brush on the cleaning roller, i.e., the change in the resistance of the agent, failing to confine the electric field in the adequate range with accuracy. It is, therefore, impracticable to enhance the cleaning ability and stabilize it over a long period of time.

SUMMARY OF THE INVENTION

It is therefore an object of the present invention to provide a cleaning control device for image forming equipment which enhances the cleaning ability and maintains it stable for a long time.

It is another object of the present invention to provide a generally improved cleaning control device for image forming equipment.

A cleaning control device for image forming equipment having at least a precleaning discharger and a cleaning device which are located to face the surface of a photoconductive element of the present invention comprises a surface potential measuring unit for measuring the surface potential of the photoconductive element before the element is cleaned by the cleaning device, a comparator for comparing the surface potential measured by the surface potential measuring unit with a predetermined reference potential, and a controller responsive to the result of the comparison by the comparator for controlling the output of the precleaning discharger such that the surface potential of the photoconductive element discharged by the precleaning discharger remains constant.

A cleaning control device for image forming equipment having at least a precleaning discharger and a cleaning device which are located to face the surface of a photoconductive element of the present invention comprises a surface potential measuring unit for measuring the surface potential of the photoconductive element before the element is cleaned by the cleaning device, a comparator for comparing the surface potential measured by the surface potential measuring unit and a predetermined reference value, and a controller for controlling the ouput of the precleaning discharger on a feed back basis such that the measured surface potential and the reference potential become equal to each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
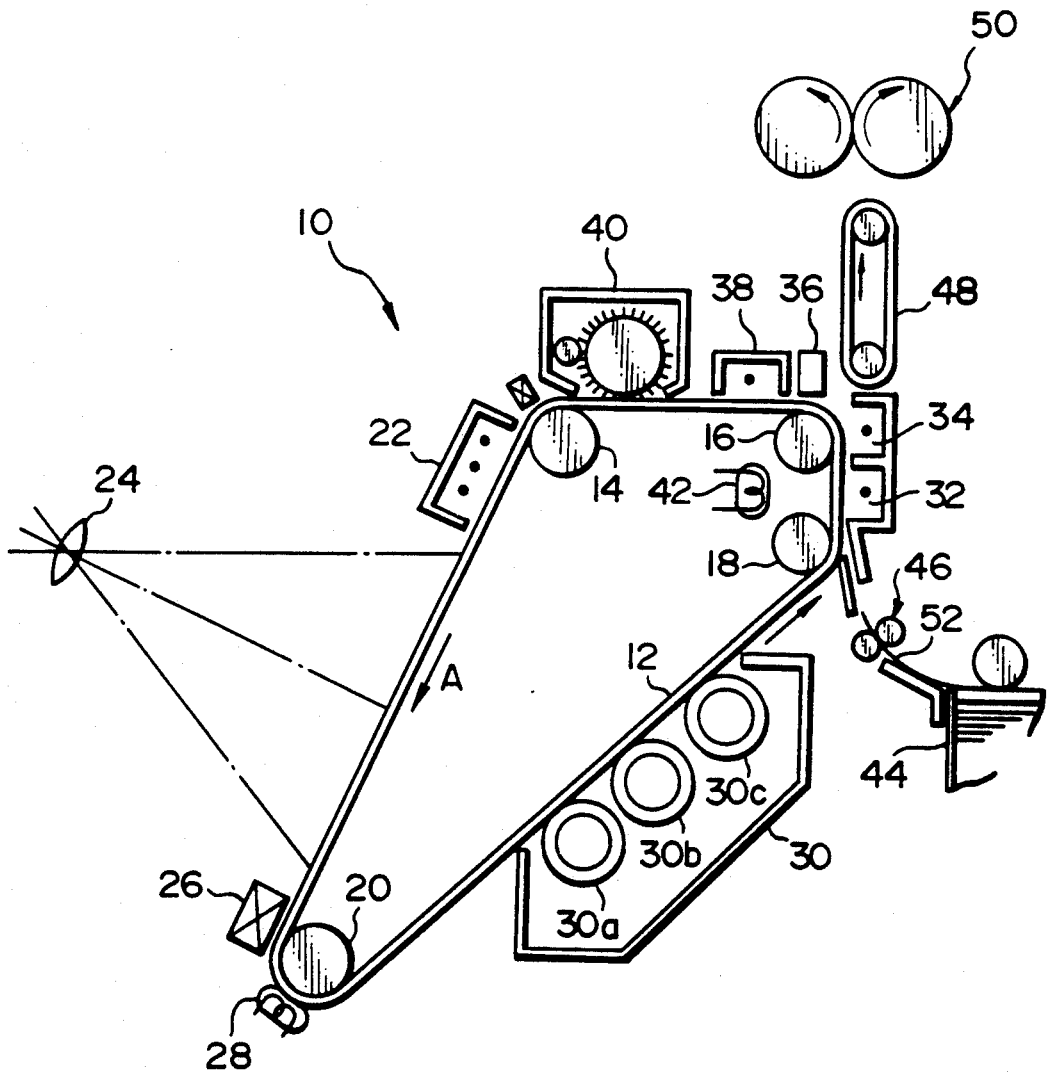
FIG. 1 is a section showing the general construction of an electrophotographic copier which is a specific form of image forming equipment and to which a first embodiment of the present invention is applied.

Referring to FIG. 1 of the drawings, an electrophotographic copier implemented with a first embodiment of the cleaning device in accordance with the present invention is shown. As shown, the copier, generally 10, has a photoconductive element in the form of a belt 12 which is passed over tension rollers 14, 16, 18 and 20. A main charger 22, an imagewise exposing device 24, a surface potential sensor 26, an eraser 28, a developing device 30, an image transferring device 32, a paper separating device 34, a photosensor array 36, a precleaning discharger 38, and a cleaning device 40 are sequentially arranged around the belt 12 in this order with respect to an image forming procedure. A discharge lamp 42 is disposed inside of the belt 12 for the purpose of enhancing efficient separation of a paper sheet. Also included in the copier 10 are a paper tray 44, a register roller pair 46, a transport belt 48, and a fixing roller pair 50. A paper sheet 52 fed from the paper tray 44 is driven to the image transferring device 32 and paper separating device 34 via the register roller pair 46. Then, a toner image formed on the belt 12 by a conventional process is transferred to the paper sheet 52 by the image transferring device 32. After the paper sheet with the toner image has been separated by the separating device 34, it is driven out of the copier 10 by the transport belt 48 via the fixing roller pair 50. The developing device 30 has developing rollers 30*a*, 30*b* and 30*c*. A two-component developer, for example, which is a mixture of toner and carrier forms a magnet brush on each of the developing rollers 30*a* and 30*c*.

Figure 2:
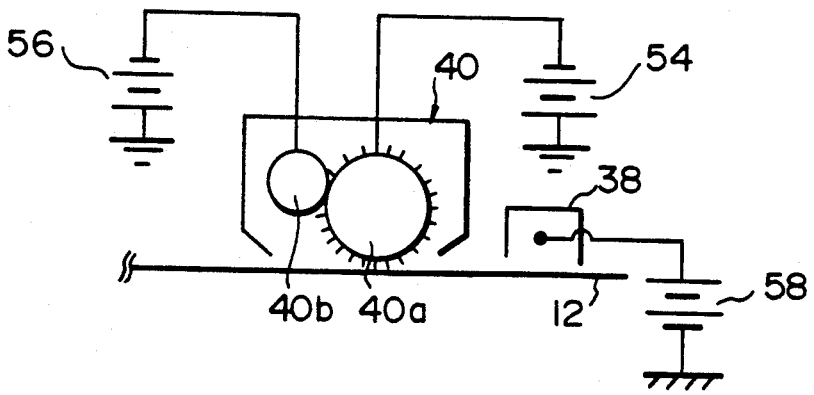
FIG. 2 is a schematic view showing a cleaning device and a precleaning discharger depicted in FIG. 1.

The precleaning discharger 38 charges the belt 12 to the same polarity as the developer, or toner, that remains on the belt 12 after the image transfer to the paper sheet 52, thereby regulating the charge of the toner for greater cleaning ability. At the same time, the discharging device 38 serves to reduce the electrostatic cohesion acting between the belt 12 and the toner. The photosensor array 36 is located next to and upstream of the discharging device 38 with respect to the intended direction of movement of the belt 12. The photosensor array 36 has a plurality of photosensors and is so positioned as to face the surface of the belt 12, so that it may output a signal representative of a sensed amount of toner remaining on the belt 12. As shown in FIG. 2, the cleaning device 40 is made up of a cleaning roller 40*a* and a scavenging roller 40*b*. A bias voltage for cleaning is applied from a bias power source 54 to the cleaning roller 40*a* to cause the cleaning agent to form a magnet brush on the roller 40*a*. A scavenging bias voltage is applied from a scavenging power source 56 to the scavenging roller 40*b*. Further, a precleaning discharge power source 58 applies a voltage to the precleaning discharger 38.

The precleaning discharger 38 charges the toner remaining on the belt 12 to the positive polarity. The bias voltage applied to the cleaning roller 40*a* from the cleaning bias power source 54 is opposite in polarity to the toner. As a result, the residual toner on the belt 12 is electrostatically removed by the cleaning roller 40*a*. The cleaning ability achievable with such a construction is greatly effected by the electric field that is developed at the time of cleaning, as stated earlier. Specifically, in the illustrative embodiment, it is dependent on the surface potential of the belt 12 undergone the precleaning discharge and the cleaning bias voltage applied to the cleaning roller 40*a*.

Figure 3:
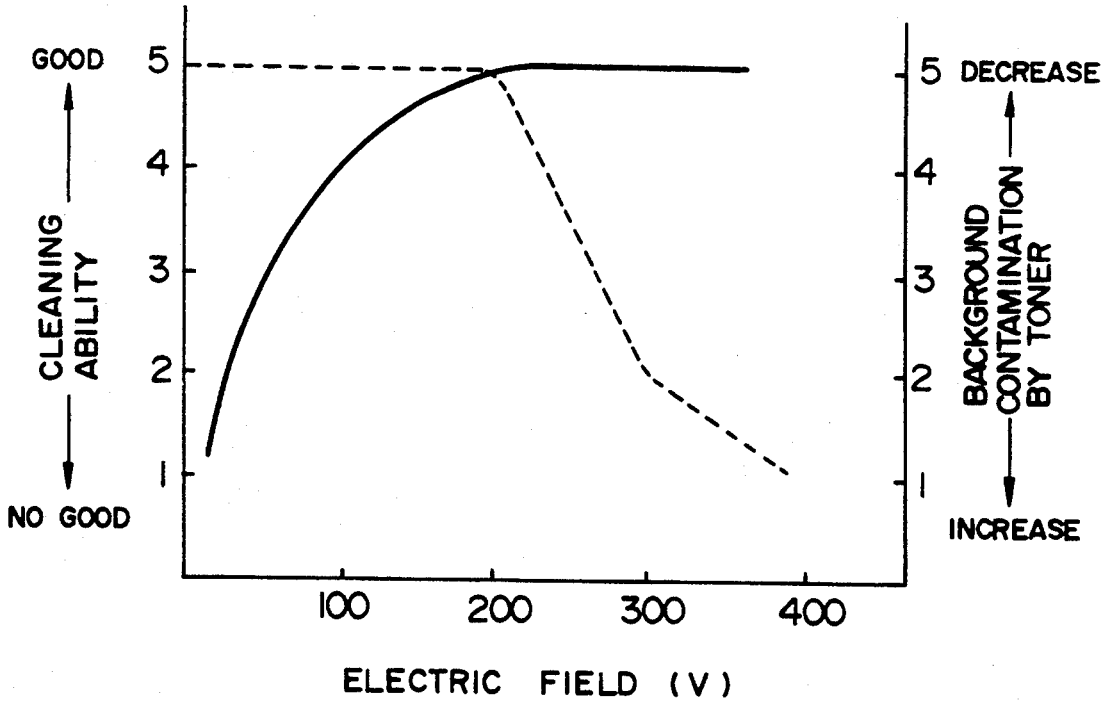
FIG. 3 is a graph representative of a cleaning characteristic particular to the illustrative embodiment.

FIG. 3 indicates a cleaning characteristic particular to the cleaning device 40. As indicated by a solid line in the graph, the cleaning ability tends to increase as the electric field for cleaning is intensified. However, when the electric field is intensified beyond a certain value, the toner deposits on the cleaned surface of the belt 12 to smear the background of an image, as indicated by a dashed line in the figure. Presumably, this is ascribable to the occurrence that excessively high bias voltages for cleaning cause reverse charges to be injected into the toner via the cleaning roller 40*a*. This electric field, therefore, has to be constantly controlled to a predetermined range. Further, since the adequate range of this electric field depends on the amount of toner remaining on the belt 12, the electric field should preferably be a minimum electric field capable of effecting cleaning.

Figure 4:
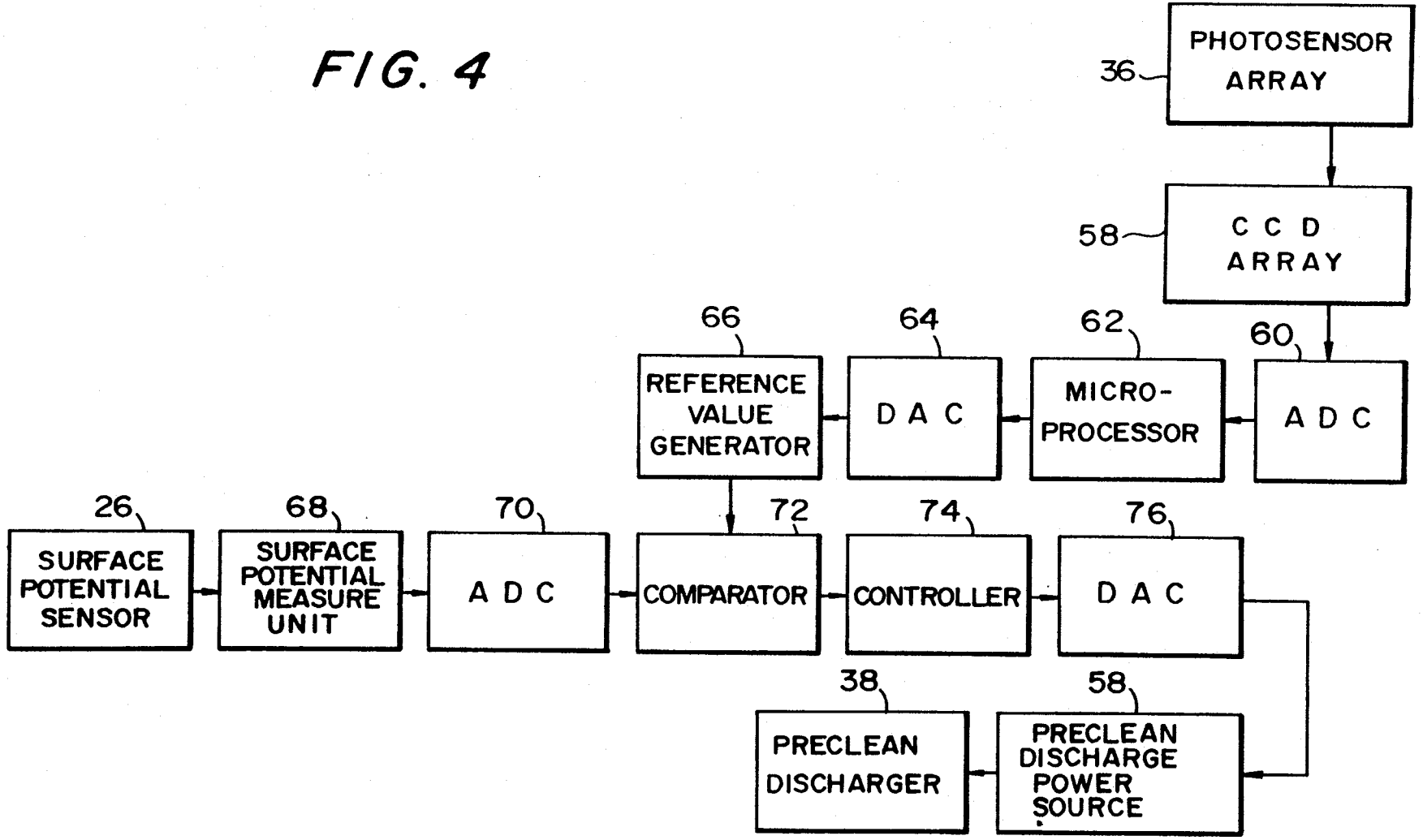
FIG. 4 is a block diagram schematically showing electric circuitry for practicing the illustrative embodiment.

Referring to FIG. 4, electric circuitry for practicing the first embodiment will be described. As shown, the output of the photosensor array 36 representative of a sensed amount of toner remaining on the belt 12 is applied to an analog-to-digital converter (ADC) 60 via a CCD (Charge Coupled Device) array 58. The resulting digital code from the ADC 60 is fed to a microprocessor 62. The output of the microprocessor 62 is in turn routed to a digital-to-analog converter (DAC) 64 and thereby converted into an analog signal. The analog signal from the DAC 64 is fed to a reference value generator 66. By such a procedure, the reference value of the surface potential, or reference potential, of the belt 12 undergone precleaning discharge is determined.

How the surface potential of the belt 12 is controlled on the basis of the reference potential will be described. First, the surface potential of the belt 12 is measured by the surface potential sensor 26 by a predetermined routine with the main charger 22 being turned off. The measured surface potential is routed through a surface potential measuring unit 68 and an ADC 70 to a comparator 72. The ADC 70 converts the analog output of the measuring unit 68 into a digital value. In response, the comparator 72 compares the actual surface potential with the reference potential generated by the reference value generator 66 and delivers the result of the comparison to a controller 74. Then, the controller 72 performs an arithmetic operation for setting up an adequate electric field for cleaning and feeds a command representative of such an electric field to the precleaning discharge power source 58 via a DAC 76. As a result, the output voltage of the power source 58 is controlled, and the so controlled output voltage is applied to the precleaning discharger 38. In this manner, a minimum electric field capable of effecting cleaning is constantly applied to the discharger 38 in association with the amount of toner remaining on the belt 12, whereby the cleaning ability is enhanced and maintained stable over a long period of time.

Figure 5:
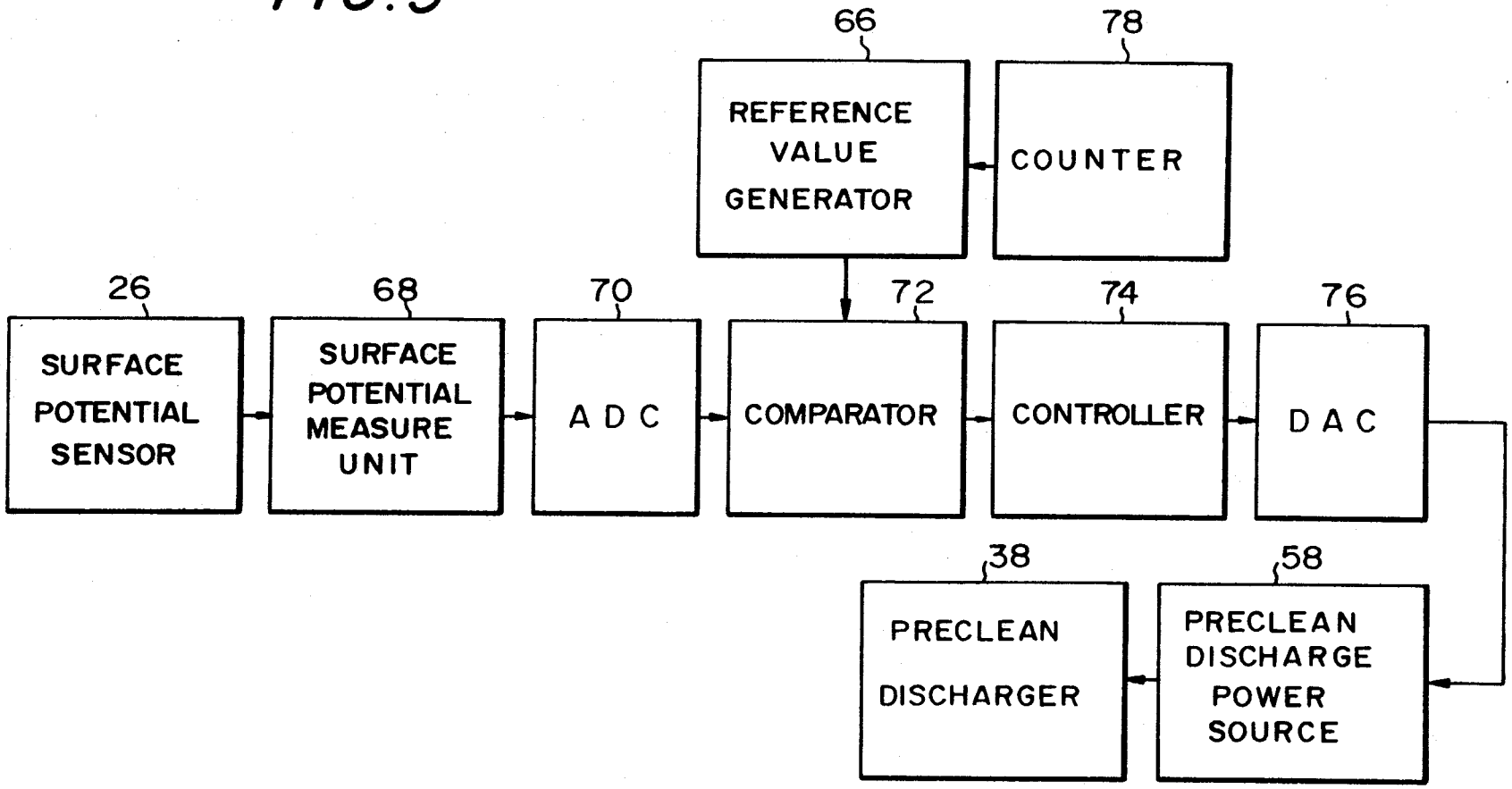
FIG. 5 is a block diagram schematically showing electric circuitry representative of a second embodiment of the present invention.

FIG. 5 shows circuitry representative of a second embodiment of the present invention. This embodiment is essentially similar to the first embodiment except that the reference potential is determined on the basis of the content of a counter 78. Specifically, in the second embodiment, the reference potential is varied in association with aging so as to insure the optimum electric field range at all times. This is also successful in insuring desirable cleaning ability and maintaining it for a long time. Table 1 shown below indicates cleaning ability and background contamination which were experimentally determined by changing and not changing the reference potential in association with aging.

TABLE 1

| AGENT | REF POTENTIAL CHANGE | REF POTENTIAL (V) | CLEAN BIAS (V) | ABILITY | CONTAMINATION |
|---|---|---|---|---|---|
| START | NO | 100 | 150 | good | much |
| | YES | 50 | 150 | good | little |
| 50K RUNS | NO | 100 | 150 | good | much |
| | YES | 100 | 150 | good | little |
| 100K RUNS | NO | 100 | 150 | medium | little |
| | YES | 200 | 150 | good | little |
| 150K RUNS | NO | 100 | 150 | no good | little |
| | YES | 300 | 150 | good | little |
| 200K RUNS | NO | 100 | 150 | no good | little |
| | YES | 350 | 150 | good | little |

As Table 1 indicates, when the reference potential is not changed despite aging, toner deposits on the belt 12 at the initial stage and thereby contaminates the background to degrade the cleaning ability. By contrast, changing the reference potential is successful in insuring stable cleaning ability and, therefore, the elimination of contamination at the initial and successive stages.

Figure 6:
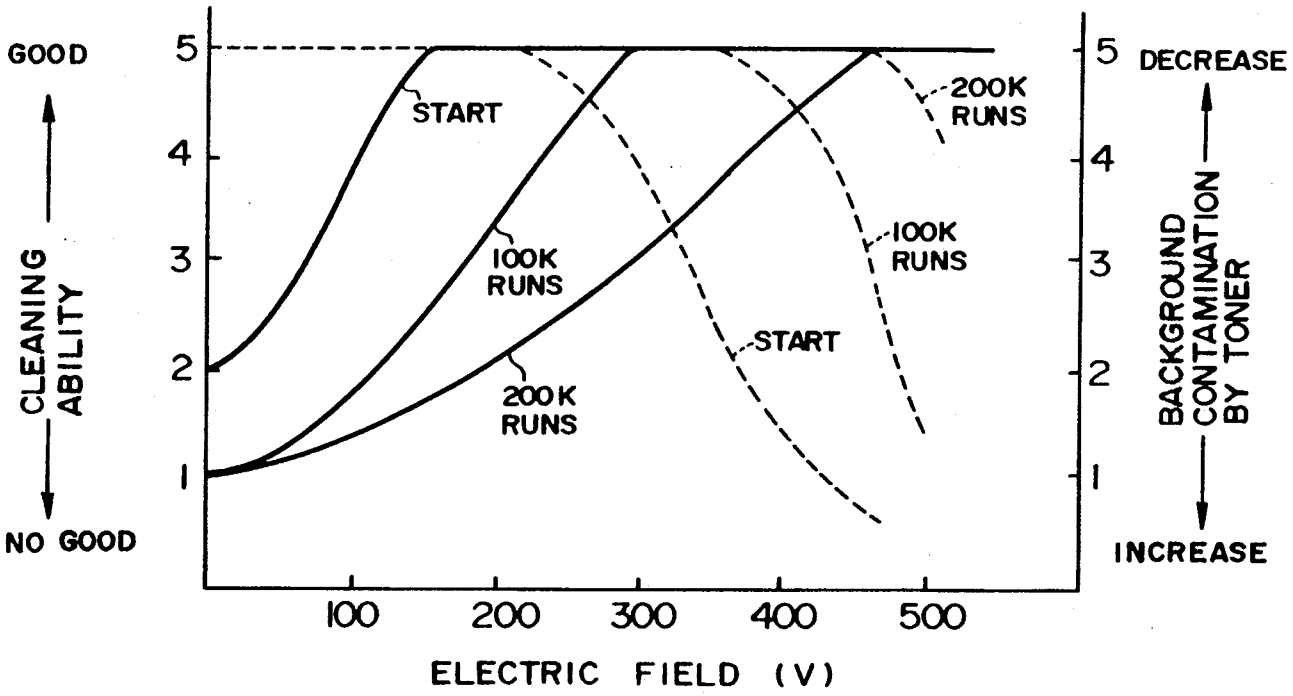
FIG. 6 is a graph indicative of a cleaning characteristic achievable with the second embodiment.

FIG. 6 is a graph showing a relationship of cleaning electric field, cleaning ability and the contamination of background by the toner to one another. As shown, the cleaning ability depends on the number of times that the cleaning agent is used, in addition to the electric field. Hence, the adequate electric field shifts due to aging. This presumably is accounted for by the spent carrier contained in the cleaning agent and on which resin and other substances have been firmly adhered. Specifically, the spent carrier increases the resistance of the cleaning agent and thereby changes the effective bias. In light of this, the second embodiment changes the reference potential of the surface potential of the belt 12 undergone precleaning discharge in association with aging.

Figure 7:
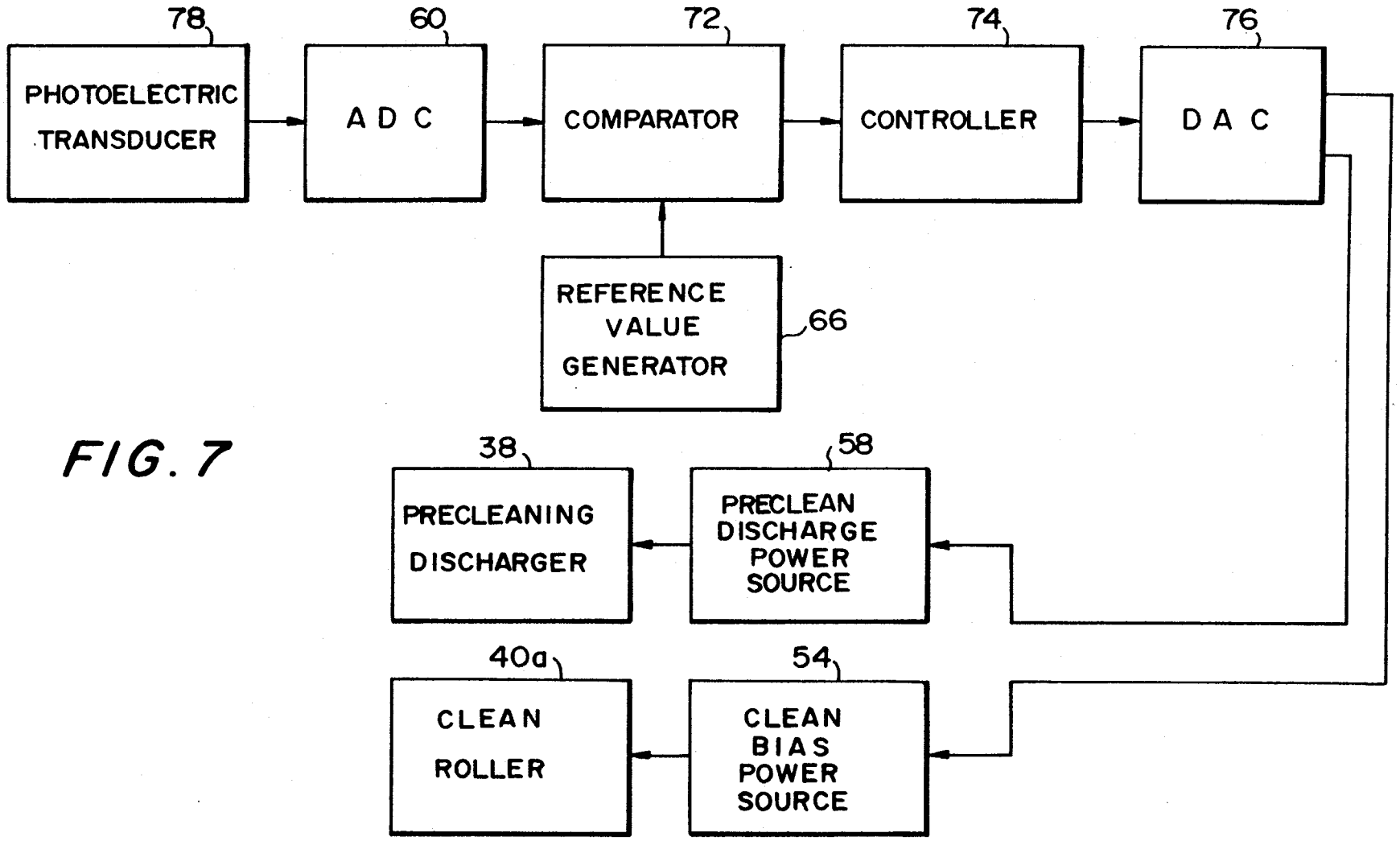
FIG. 7 is a block diagram schematically showing electric circuitry representative of a third embodiment of the present invention.

FIG. 7 shows an electric circuit representative of a third embodiment of the present invention. In this particular embodiment, a photoelectric transducer 78 detects the amount of toner remaining on the belt 12. The output of the photoelectric transducer 78 is digitally coded by the ADC 60 and then compared with the reference value of the reference value generator 66 by the comparator 72. The result of the comparison is fed to the controller 74. The resulting output of the controller 74 is routed through the DAC 76 to the precleaning discharge power source 58 and cleaning bias power source 54. In the illustrative embodiment, one or both of these power sources 58 and 54 are controlled to stabilize the cleaning ability and to free the belt 12 from background contamination and deterioration.

Figure 8:
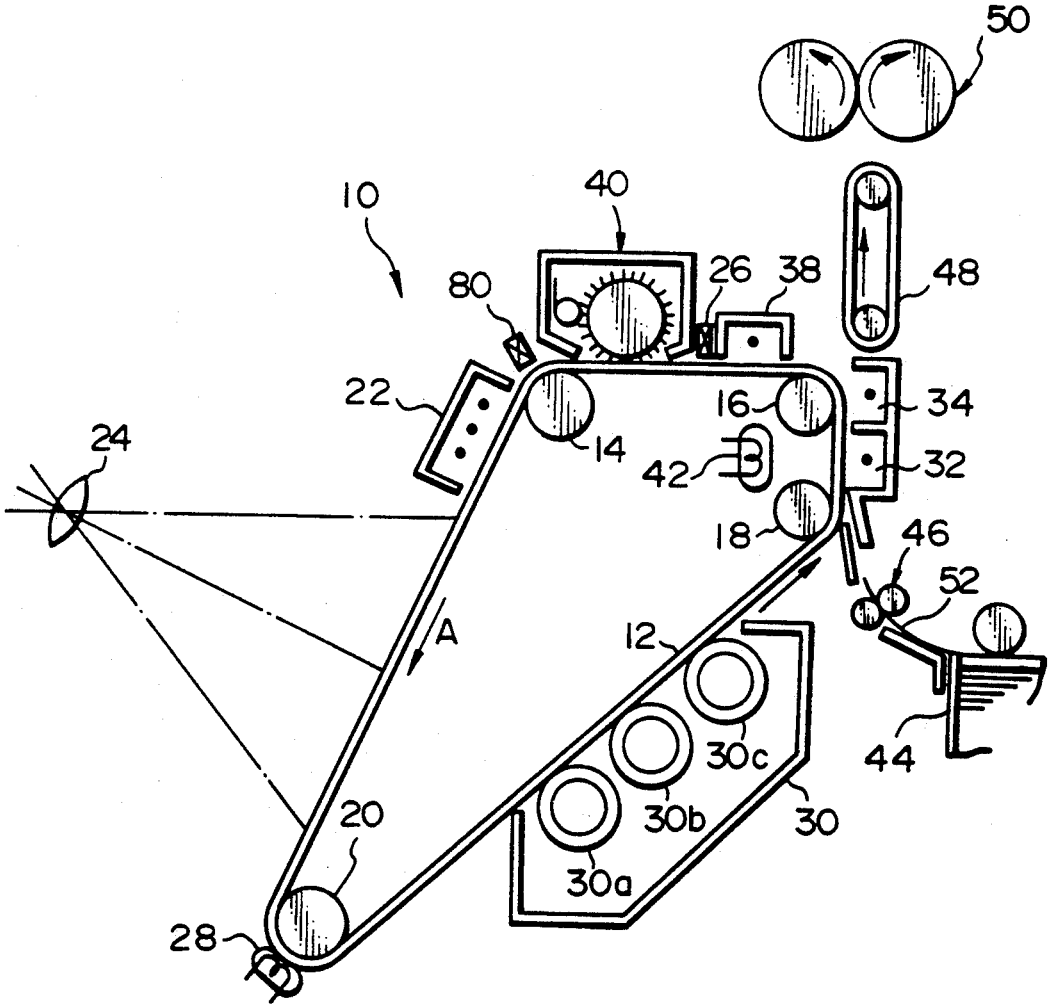
FIG. 8 is a section showing an electrophotographic copier to which a fourth embodiment of the present invention is applicable.
Figure 9:
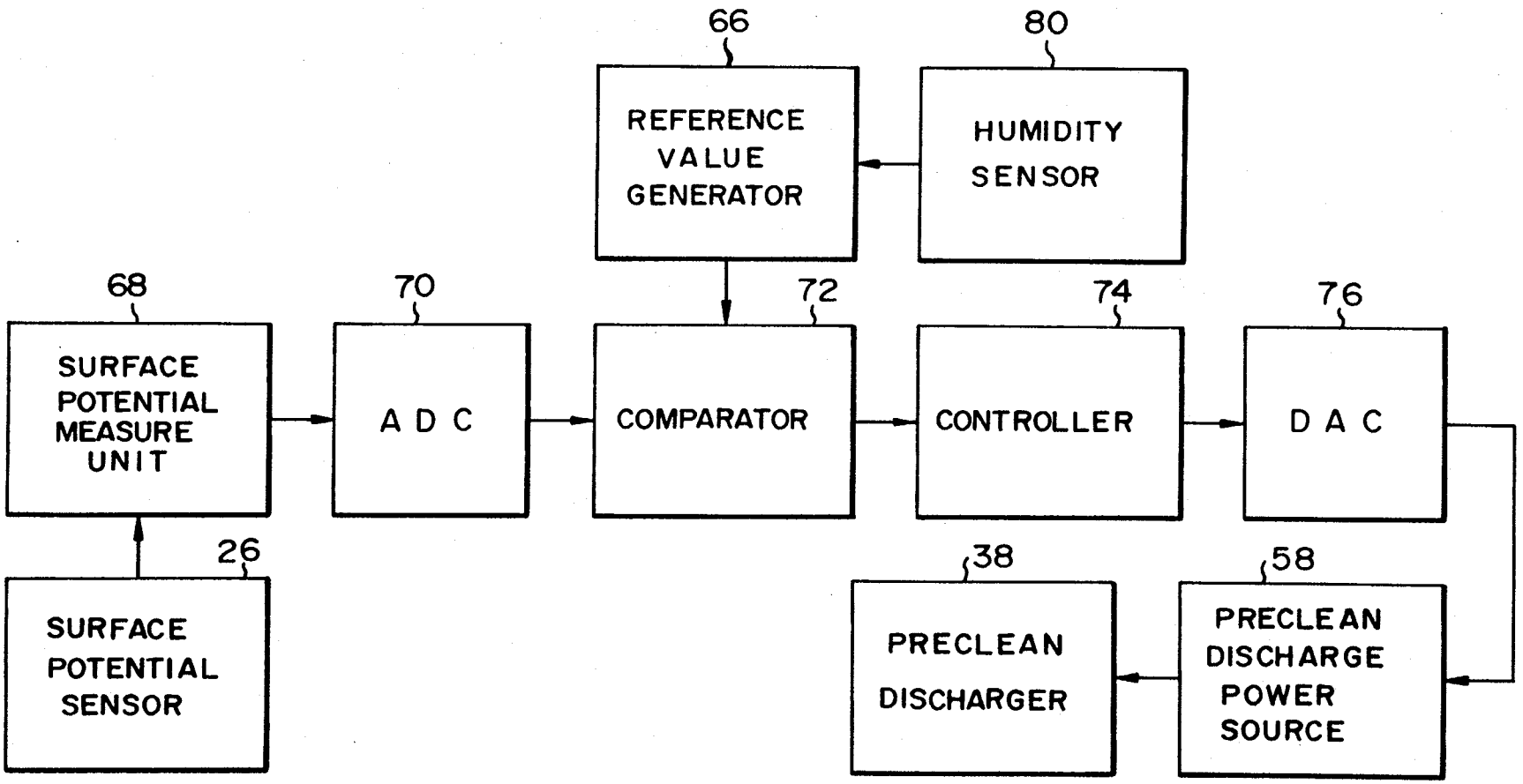
FIG. 9 is a schematic block diagram showing electric circuitry for implementing the fourth embodiment.

FIG. 8 shows an electrophotographic copier implemented with a fourth embodiment of the present invention. This embodiment is different from the embodiment of FIG. 1 in that the surface potential sensor 26 is interposed between the precleaning discharger 38 and the cleaning device 40, and in that a humidity sensor 80 is located between the cleaning device 40 and the main charger 22. Circuitry for practicing the fourth embodiment is shown in FIG. 9. As shown, the surface potential sensor 26 senses the surface potential of the belt 12, and then the surface potential measuring unit 68 measures it as an analog value. The analog value is converted into a digital value by the ADC 70. The comparator 72 compares the digital value or potential with a reference potential which is generated by the reference value generator 66. In this particular embodiment, the reference value varies with the output of the humidity sensor 80 which is responsive to the humidity of the space around the belt 12. The result of the comparison of the measured surface potential and reference surface potential is applied to the controller 74. In response, the controller 74 produces a digital signal for equalizing the measured or actual surface potential and the reference potential. The output of the controller 74 is converted into an analog signal by the DAC 76 and then applied to the precleaning discharge power source 58 to control the voltage to be fed from the power source 58 to the discharger 38. As a result, the surface potential of the belt 12 whose surface has been discharged is controlled to the reference potential at all times.

Figure 10:
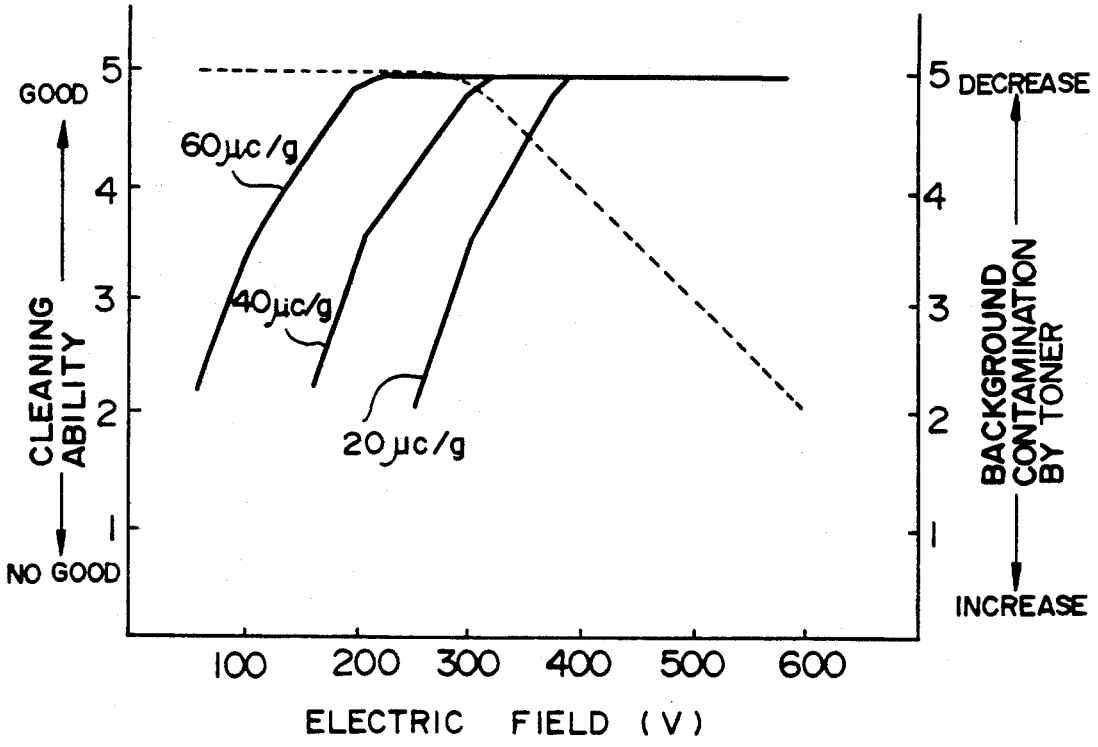
FIG. 10 is a graph indicative of a cleaning characteristic particular to the fourth embodiment.
Figure 11:
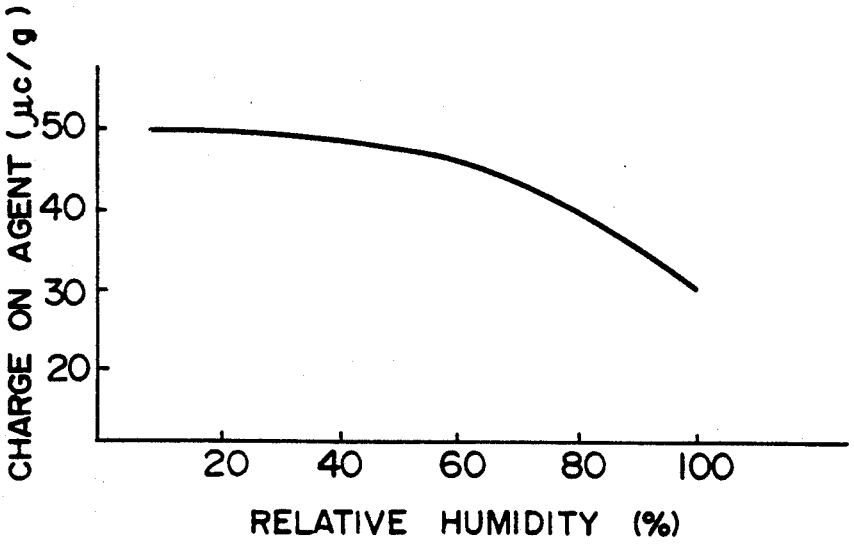
FIG. 11 is a graph showing a relation between the amount of charge deposited on a cleaning agent and the relative humidity.

On the other hand, the cleaning ability is noticeably influenced by the electric field developed at the time of cleaning, i.e., the sum of the surface potential after the discharge by the precleaning discharger 38 and the cleaning bias voltage applied to the cleaning roller 40*a*, and on the amount of charge (μc/g) of the cleaning agent used, as shown in a graph in FIG. 10. As the solid line of FIG. 10 indicates, the cleaning ability increases with the increase in the electric field for cleaning. However, the cleaning ability cannot be maintained constant unless the electric field in intensified with the decrease in the amount of charge of the cleaning agent. On the other hand, when the electric field is higher than about 300 V, the toner is apt to deposit on the cleaned surface of the belt 12 to contaminate the background, as indicated by a dotted line in the figure. This is probably because excessively high bias voltages applied to the cleaning roller 40*a* of the cleaning device 40 cause opposite charges to be injected into the toner on the belt 12 via the roller 40*a*, as stated previously. FIG. 11 shows a relation between the amount of charge deposited on the cleaning agent and the relative humidity. As FIG. 11 indicates, the amount of charge of the cleaning agent (μc/g) tends to decrease with the increase in relative humidity. Therefore, to reduce background contamination while enhancing cleaning ability, it is preferable that the amount of charge of the cleaning agent be 40 μc/g and that the electric field for cleaning be 300 V. This is attainable by changing the reference voltage for controlling the voltage applied to the precleaning discharger 38 in association with the change in humidity, as shown in FIG. 9, and thereby setting up the desired electric field (e.g. 300 V) at all times. Then, the electric field for cleaining will be stabilized to enhance cleaning ability.

While the illustrative embodiments have been shown and described in relation to an electrophotographic copier, they are similarly applicable to a laser beam printer, facsimile transceiver or similar image forming equipment of the type having precleaning discharger.

In summary, it will be seen that the present invention controls, before the removal of a toner remaining on a photoconductive element, the surface potential of the photoconductive element to a predetermined value on the basis of the amount of remaining toner. Since the reference potential of the photoconductive element is determined in association with the amount of remaining toner, a minimum electric field capable of effecting cleaning is applied at all times. The reference potential is changed in response to aging. The remaining amount of toner is detected by a photoelectric transducer, while the electric field for cleaning is controlled in response to the detected amount of remaining toner. Further, the reference potential is changed in response to the instantaneous humidity around the photoconductive element.

With the above construction, the present invention enhances cleaning ability and maintains it over a long period of time.

Various modifications will become possible for those skilled in the art after receiving the teachings of the present disclosure without departing from the scope thereof.

What is claimed is:

1. A cleaning control device for image forming equipment having at least precleaning discharging means and cleaning means which are located to face a surface of a photoconductive element, said device comprising:

surface potential measuring means for measuring a surface potential of the photoconductive element before said photoconductive element is cleaned by said cleaning means;

comparing means for comparing the surface potential measured by said surface potential measuring means with a predetermined reference potential;

reference potential changing means for changing said reference potential in response to a parameter; and control means responsive to a result of the comparison by said comparing means for controlling an output of said precleaning discharging means such that the surface potential of the photoconductive element discharged by said precleaning discharging means remains constant.

2. A device as claimed in claim 1, wherein said parameter comprises at least one of aging of a cleaning agent and a humidity around the surface of the photoconductive element.

3. A device as claimed in claim 2, further comprising humidity sensor means for sensing the humidity around the surface of the photoconductive element.

4. A device as claimed in claim 2, wherein said reference potential is changed to increase a cleaning electric field as said cleaning agent is aged.

5. A device as claimed in claim 2, wherein said reference potential is changed to decrease a cleaning electric field as said humidity is increased.

6. A device as claimed in claim 2, further comprising photosensor means located next to and upstream of said precleaning discharging means with respect to an intended direction of movement of the photoconductive element for detecting an amount of toner remaining on said photoconductive element to produce data representative of said reference potential.

7. A device as claimed in claim 2, wherein at least one of a cleaning bias output applied to said cleaning means and said output of said precleaning discharging means is controlled in response to the amount of toner remaining on the photoconductive element.

* * * * *